US005552954A

United States Patent [19]

Glehr

[11] Patent Number: 5,552,954

[45] Date of Patent: Sep. 3, 1996

[54] METHOD FOR TRIGGERING PARALLEL RELAYS AND CIRCUIT FOR CARRYING OUT THE METHOD

[75] Inventor: Manfred Glehr, Eggenfelden, Germany

[73] Assignee: Siemens Aktiengesellschaft, Munich, Germany

[21] Appl. No.: 314,153

[22] Filed: Sep. 28, 1994

[30] Foreign Application Priority Data

Sep. 28, 1993 [DE] Germany ..... 43 32 995.0

[51] Int. Cl.[6] ..... H01H 47/04

[52] U.S. Cl. ..... 361/191; 361/15.4

[58] Field of Search ..... 361/154, 155, 361/156, 159, 191, 161–169.1

[56] References Cited

U.S. PATENT DOCUMENTS 5,107,391 4/1992 Siepmann ..... 361/168.1
5,317,475 5/1994 Siepmann ..... 361/154

FOREIGN PATENT DOCUMENTS 0392058 10/1990 European Pat. Off. .
3208660 9/1982 Germany .
3609629 10/1986 Germany .
3331678 2/1990 Germany .
3434343 5/1992 Germany .

*Primary Examiner*—Fritz M. Fleming
*Attorney, Agent, or Firm*—Herbert L. Lerner; Laurence A. Greenberg

[57] ABSTRACT

A method for triggering a plurality of relay exciter coils connected parallel to a common voltage source includes turning each of the coils on and off with relay switching means associated with the coils, and triggering the respective coils to be turned on after reaching a response state thereof with a common clock generator having a given clock ratio, through the relay switching means, for establishing a steady state of a holding current being reduced relative to the response state. The method further includes turning off the coils with a common OFF-switch, keeping the respective relay switching means closed for those coils being intended to continue to be operated in the steady state of the holding current, for establishing a response current rising within a short time within the associated coil, and triggering the coil again with the clock generator having the given clock ratio after a predetermined period of time. A circuit for carrying out the method includes diodes each being connected parallel to a respective one of the coils. Each diode is connected in the blocking direction through a common Zener diode connected in series in the blocking direction to the voltage source. The common OFF-switch is connected parallel to the Zener diode.

6 Claims, 3 Drawing Sheets

FIG. 2
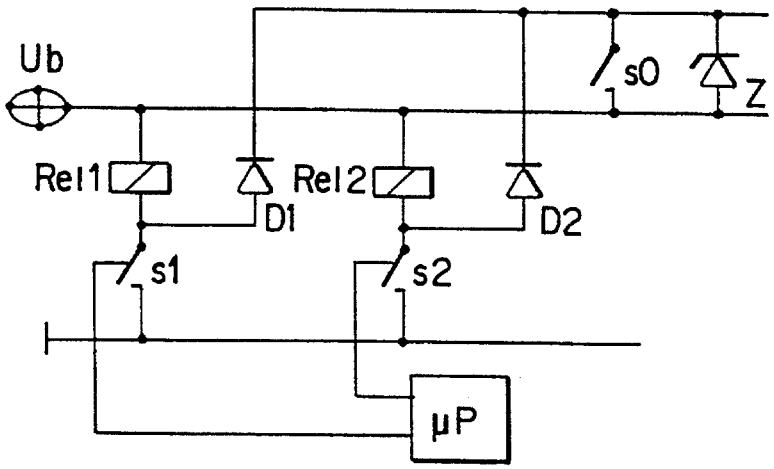
FIG. 3
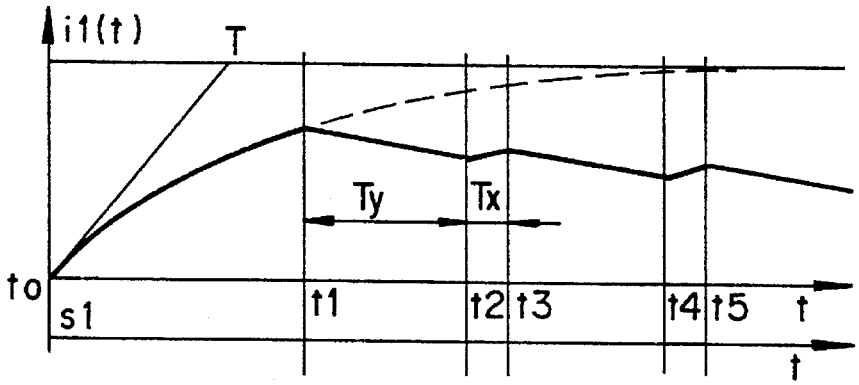
FIG. 4B
FIG. 4A
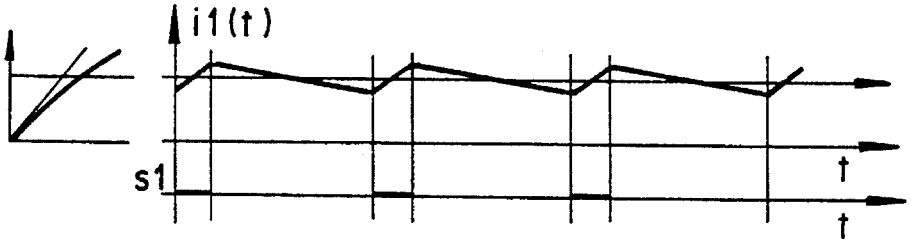

METHOD FOR TRIGGERING PARALLEL RELAYS AND CIRCUIT FOR CARRYING OUT THE METHOD

BACKGROUND OF THE INVENTION

Field of the Invention

The invention relates to a method for triggering a plurality of relay exciter coils connected parallel to a common voltage source, each of which coils can be turned on and off by relay switching means associated with them, wherein the relay exciter coils to be turned on at a given time, after reaching their response state, are triggered through relay switching means by a common clock generator with a clock ratio in such a way that a steady state of a holding current that is reduced relative to the response state is established. The invention also relates to a circuit for carrying out the method.

A relay is known to have an armature through which switch contacts can be actuated. The force required for the actuation must be brought to bear by the relay exciter coil. A certain current through the exciter coil is necessary in order attract the armature and to the actuate the switch contacts, for a given number of windings on the exciter coil. Since the losses in the magnetic circuit caused by the air gap become less after the attraction of the armature, a lower current than for the attraction suffices to hold the contacts. As a consequence, in general the trigger current of the relay in such a case can be reduced to from one-half to one-third, and as a result the power loss is reduced because of the lower holding current and the attendant warming up of the exciter coil.

Various methods are known to reduce the holding current. One known method includes reducing the holding current, once the response state is reached, by switching over to a voltage source that has a lower supply voltage. Another known method includes triggering the relay, once the response state is reached, with a clock ratio, so that the holding current drops to a steady-state final condition. A further known method is to supply the relay initially with a higher trigger voltage, which can be done with the aid of a voltage multiplier.

If a plurality of relays or relay groups are to be supplied from one voltage source, then a separate circuit is necessary to clock each relay, for example. That entails major expenditure for circuitry and thus high manufacturing costs.

SUMMARY OF THE INVENTION

It is accordingly an object of the invention to provide a method for triggering parallel relays and a circuit for carrying out the method, which overcome the hereinaforementioned disadvantages of the heretofore-known methods and devices of this general type and with which a plurality of relays can be operated in a manner that economizes on components and has low loss.

With the foregoing and other objects in view there is provided, in accordance with the invention, in a method for triggering a plurality of relay exciter coils connected parallel to a common voltage source, which includes turning each of the relay exciter coils on and off with relay switching means associated with the relay exciter coils, and triggering the relay exciter coils to be turned on at a given time after reaching a response state thereof with a common clock generator having a given clock ratio, through the relay switching means, for establishing a steady state of a holding current being reduced relative to the response state, the improvement which comprises turning off the relay exciter coils with common OFF-switching means, keeping the respective relay switching means closed for those relay exciter coils being intended to continue to be operated in the steady state of the holding current, for establishing a response current rising within a short time within the associated relay exciter coil, and triggering the relay exciter coil again with the clock generator having the given clock ratio after a predetermined period of time.

In accordance with another mode of the invention, there is provided a method which comprises determining the predetermined period of time with a period of time until the respective relay exciter coil has reached the response state.

In accordance with a further mode of the invention, there is provided a method which comprises triggering relay exciter coils being of the same type.

In accordance with an added mode of the invention, there is provided a method which comprises triggering only a partial group of relay exciter coils being of the same type.

In accordance with a concomitant mode of the invention, there is provided a method which comprises calculating and setting the predetermined period of time with a microprocessor.

With the objects of the invention in view, there is also provided a circuit for carrying out the method, comprising diodes each being connected parallel to a respective one of the coils, each of the diodes being connected in the blocking direction through a common Zener diode connected in series in the blocking direction to the voltage source, and the common OFF-switch being connected parallel to the Zener diode.

Other features which are considered as characteristic for the invention are set forth in the appended claims.

Although the invention is illustrated and described herein as embodied in a method for triggering parallel relays and a circuit for carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2 is a schematic diagram of a circuit layout for triggering two relays;

FIG. 3 is a diagram showing a current course for explaining the mode of operation of the circuit configuration of FIG. 2;

FIG. 4A is a diagram showing a current course for explaining the steady state of the configuration of FIG. 2;

FIG. 4B is an enlarged detail showing a actual current rise;

DESCRIPTION OF THE PREFERRED EMBODIMENTS

Figure 1:
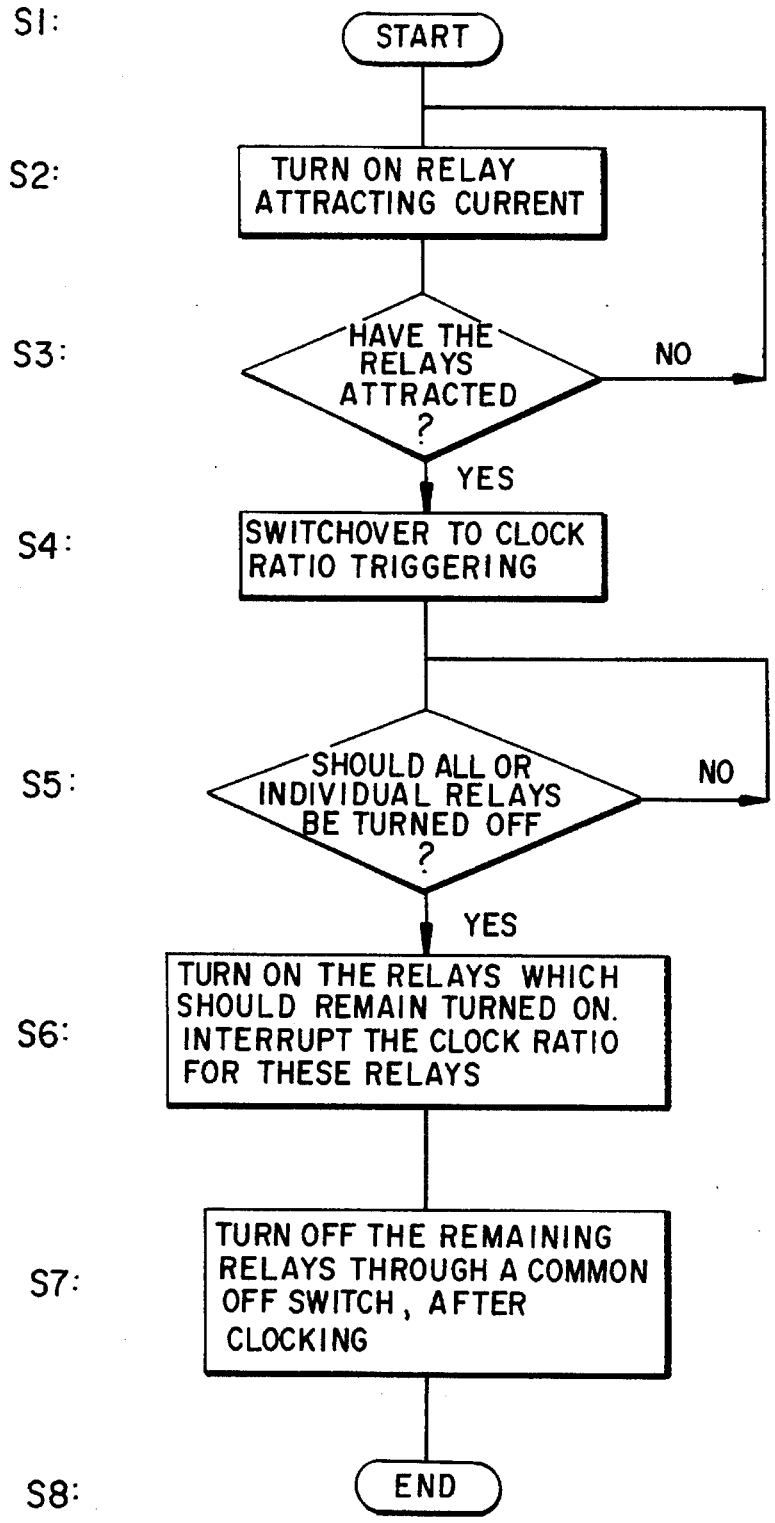
FIG. 1 is a flowchart for explaining the course of the method according to the invention.

Referring now to the figures of the drawing in detail and first, particularly, to FIG. 1 thereof, there is seen a flowchart which illustrates the course of the method for turning a plurality of relays on and off. A routine begins in a step S1. In an ensuing step S2, all of the desired relays are turned on. In an ensuing decision step S3, a decision is made as to whether or not the desired relays have attracted. If the decision is "no", then the desired relays are resupplied with the attracting current. If the decision is "yes", the routine proceeds to a step S4, where the desired relays are triggered with a clock ratio. In a further step S5, it is ascertained whether all of the relays or individual relays are to be turned off. If the decision is "no", then this relay or relays are triggered further with the clock ratio in step S4. If the decision is "yes" then in a step S6 the relays that are to remain on are turned on in fixed fashion, in other words without a clock ratio, through a switch. In an ensuing step S7, a common OFF switch is simultaneously actuated. Through the use of this OFF switch, the relays that are to be turned off are turned off rapidly. The routine ends at a step S8.

FIG. 2 shows a circuit configuration with which a clocked triggering can be carried out. As an example, two relay exciter coils Rel 1 and Rel 2 are connected in parallel to a voltage source Ub, and each can be switched by a respective series-connected switch s1, s2. Diodes D1, D2, which are connected in the blocking direction, are each connected parallel to a respective one of the relay exciter coils Rel 1, Rel 2. A common Zener diode Z, which is operated in the blocking direction, is connected to the diodes D1, D2 and has an anode which is connected to the voltage source Ub. A common OFF switch so is connected parallel to the Zener diode Z, and the Zener diode Z can be bypassed by the switch s0. The switches s1, s2 can be switched in clocked fashion by a non-illustrated clock generator, in accordance with the method.

FIG. 3 shows a chronological course of the current as a function of time in a diagram which shows the course of a current through the relay exciter coil Rel 1 as an example. At a time t0, the relay exciter coil Rel 1 is connected to the voltage source Ub by the switch s1, as a result of which the current in the relay exciter coil Rel 1 rises with a delay, among other reasons because of an incident induction voltage, which acts counter to the voltage Ub being applied. The common OFF switch so is closed. At a time t1, the response state of the relay Rel 1 is supposed to be attained. A small brake in the current curve, which occurs as a result of the then-varying inductance from the attraction of the armature, is not shown. At the time t1, the response state of the relay exciter coil Rel 1 is accordingly attained. The time t1 is determined beforehand by measurement or calculation from the current supply voltage Ub, the ohmic resistance of the relay exciter coil, the inductance, and the temperature that comes to be established.

At the time t1, the switch s1 begins to clock, because of the triggering of the clock generator. Thus the switch s1 is opened at the time t1, so that a current i1 in the relay exciter coil Rel 1 drops. A negative turn-off voltage peak that occurs at the time t1 breaks down, because of the diode D1, to the value of its forward voltage drop, so that the turn-off peak is reduced. The common OFF switch so remains closed.

At a time t2, the switch s1 is closed again by the clock generator, with the result that the current i1 in the relay exciter coil Rel 1 rises again. At a time t3, the switch s1 is reopened, so that the current i1 in the relay exciter coil Rel 1 rises again. This process continues in alternation over times t4, t5, so that after a certain period of time, the final steady state shown in FIG. 4A is established. The current i1 forms a holding current at which the relay armature remains attracted. The magnitude of the current i1 is determined by a ratio suggested in FIG. 3, between an ON duration Tx and an OFF duration Ty, which ratio is known as the clock ratio.

The turn-off procedure will be explained with regard to FIG. 5, on the assumption that the relay exciter coil Rel 1 is to be turned off and the relay exciter coil Rel 2 is to remain on.

Figure 5:
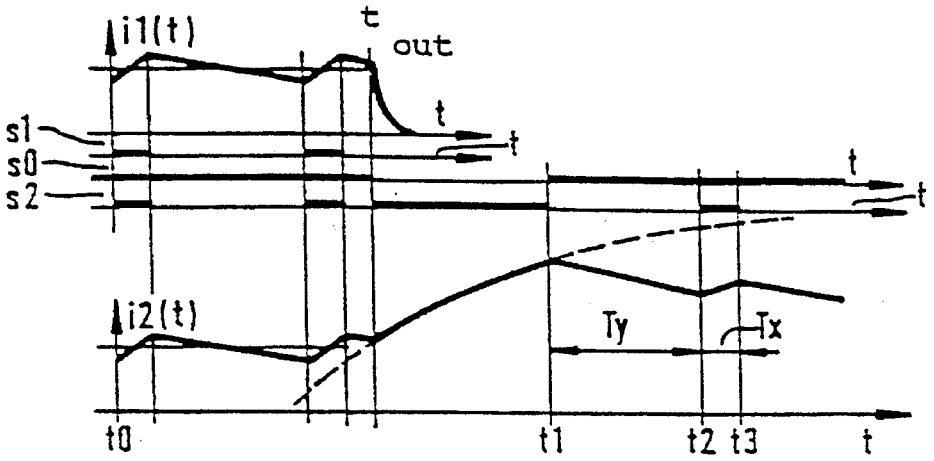
FIG. 5 is a diagram showing a current course for explaining the process of turning off the configuration of FIG. 2.

In the diagram shown in FIG. 5, a current course i1(t) in the relay exciter coil Rel 1, a current course i2(t) in the relay exciter coil Rel 2, and the switch positions s1, s2, so are shown. The heavy lines for the switch positions are intended to indicate the closed state of these switches.

The chronological course of the currents i1 and i2 at times t0 through $t_{out}$ corresponds to the current course for the steady state shown in FIG. 3 and 4. Accordingly, the current i1 through the relay exciter coil Rel 1 is controlled in clocked fashion, as is the current i2 through the relay exciter coil Rel 2. The switches s1 and s2 are controlled in clocked fashion in accordance with the clock ratio. The switch so is still closed.

At the time $t_{out}$, it is decided that the relay exciter coil Rel 1 is to be turned off. Thus the switch s1 is opened, causing the current i1 to drop as indicated by the turn-off curve shown in FIG. 5. At the same time, the common OFF switch s0 opens, so that the turn-off voltage peak of the relay exciter coil Rel 1 across the diode D1 and the common Zener diode is limited. In order to ensure that the turn-off operation for the relay coil Rel 1 will proceed rapidly, all of the relays should be operated with the highest possible turn-off voltage. Therefore at the time $t_{out}$, the switch s0, which serves as a common OFF switch, is opened as well. The reason for this is that the switch S0 has a certain resistance in the "ON" position (the switch can be constructed as a transistor switch), while conversely the resistance of the Zener diode in the region of the breakdown voltage is extremely small, so that the relay exciter coil Rel 1 is discharged rapidly through the diode D1, which leads to a desired rapid drop of the relay armature of the exciter coil Rel 1. During the discharge, the voltage between the diode D1 and the Zener diode rises steeply within a short time, so that if the switch s2 were to be triggered further in clocked fashion in this state, or in other words if the switch s2 were also to be turned off intermittently, then the relay Rel 2 would drop as well. However, in order to ensure that the relay exciter coil Rel 2 (and possible other relay exciter coils) will not turn off as well, the switch s2 (and possible other switches) is closed, and remains in a closed position in a non-clocked mode up to the time t1, and when the time t1 is reached, as was already described in conjunction with FIG. 3, a switchover back to the clocked mode is made. During that phase, although the power loss is again somewhat higher, the expenditure for components is substantially less.

Figure 6:
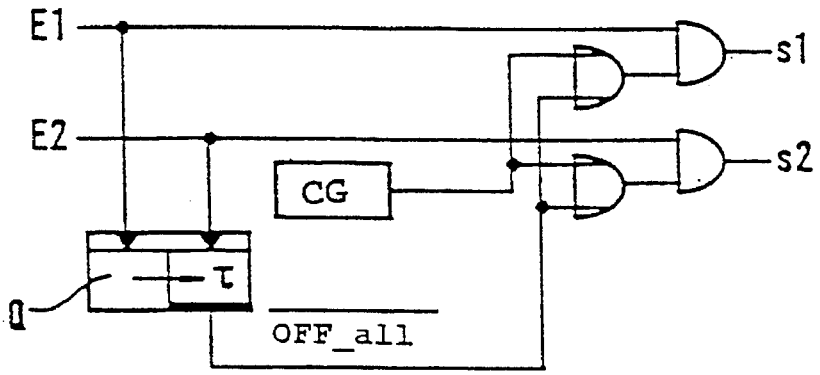
FIG. 6 is a schematic and block diagram of a circuit configuration for explaining trigger signals of the configuration of FIG. 2.

FIG. 6 illustrates part of a circuit for generating trigger signals for the switches s1 and s2, although this task can also be performed by a microprocessor.

The circuit includes two inputs E1, E2, each of which is connected to one input of an AND element, and signals for S1, S2 can be picked up at respective outputs of the AND elements. The inputs E1, E2 are also connected to a monostable retriggerable flip-flop Q, which in this case has two negatively edge-controlled inputs. An output of the flip-flop is connected to one input of each of two OR elements, and the other respective inputs of the two OR elements are connected to a clock generator CG. Respective outputs of the two OR elements are connected to other respective inputs and of the AND elements.

Figure 7:
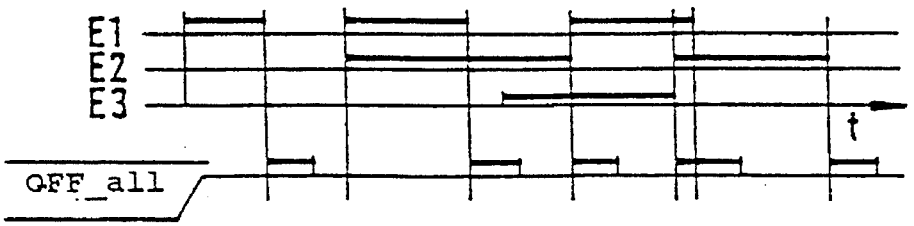
FIG. 7 is a diagram showing switch positions of three relays, and a corresponding output signal of a monostable, retriggerable flip-flop.

In FIG. 7, three relay signals are shown as an example. At each trailing edge of the input signal, or in other words when the triggering of the relay stops, an OFF_all pulse is supposed to be created. If two pulses overlap one another, then the latter of the two should be definitive. In other words, the monostable flip-flop must be retriggerable. The trigger signal for the switch so is logically identical to the OFF_all pulse, except that a potential shift must be carried out.

I claim:

1. In a method for triggering a plurality of relay exciter coils connected parallel to a common voltage source, which includes turning each of the relay exciter coils on and off with relay switching means associated with the relay exciter coils, and triggering the respective relay exciter coils to be turned on after reaching a response state thereof with a common clock generator having a given clock ratio, through the relay switching means, for establishing a steady state of a holding current being reduced relative to the response state, the improvement which comprises:

turning off the relay exciter coils with common OFF-switching means, closing the relay switching means and keeping the respective relay switching means closed for those relay exciter coils which are intended to continue to be operated in the steady state of the holding current, for establishing a response current rising within a short time within the associated relay exciter coils, and triggering the relay exciter coils again with the clock generator having the given clock ratio after a predetermined period of time.

2. The method according to claim 1, which comprises defining the predetermined period of time as a period of time necessary for the respective relay exciter coil to reach the response state.

3. The method according to claim 1, which comprises triggering substantially identical relay exciter coils.

4. The method according to claim 1, which comprises triggering only a partial group of relay exciter coils being substantially identical.

5. The method according to claim 1, which comprises calculating and setting the predetermined period of time with a microprocessor.

6. In a device having a plurality of relay exciter coils connected parallel to a common voltage source, a circuit configuration for triggering the relay exciter coils, comprising:

relay switching means connected to said relay exciter coils for turning each of said relay exciter coils on and off;

a Zener diode connected in the blocking direction in series with the common voltage source;

diodes each being connected parallel to a respective one of the relay exciter coils and being connected in the blocking direction through said Zener diode to the common voltage source;

a common clock generator having a given clock ratio and being connected to said relay switching means for triggering the respective relay exciter coils to be turned on after reaching a response state thereof for establishing a steady state of a holding current being reduced relative to the response state; and common OFF-switching means connected parallel to said Zener diode for turning off the relay exciter coils;

said respective relay switching means remaining closed for those relay exciter coils which are intended to continue to be operated in the steady state of the holding current after said OFF-switching means have turned off the relay exciter coils, for establishing a response current rising within a short time within the associated relay exciter coils, and the relay exciter coils being triggered again with said clock generator having the given clock ratio after a predetermined period of time.

* * * * *